US007793566B2

(12) United States Patent
Ypma

(10) Patent No.: US 7,793,566 B2
(45) Date of Patent: Sep. 14, 2010

(54) PEDAL WITH HYSTERESIS MECHANISM

(75) Inventor: Kirk A. Ypma, Rockford, MI (US)

(73) Assignee: Grand Haven Stamped Products Company, division of JSJ Corporation, Grand Haven, MI (US)

( * ) Notice: Subject to any disclaimer, the term of this patent is extended or adjusted under 35 U.S.C. 154(b) by 990 days.

(21) Appl. No.: 11/553,186

(22) Filed: Oct. 26, 2006

(65) Prior Publication Data

US 2007/0137395 A1 Jun. 21, 2007

Related U.S. Application Data

(60) Provisional application No. 60/731,880, filed on Oct. 31, 2005.

(51) Int. Cl.
*G05G 1/30* (2008.04)

(52) U.S. Cl. ..... 74/513

(58) Field of Classification Search ..... 74/512, 74/513, 514, 560

See application file for complete search history.

(56) References Cited

U.S. PATENT DOCUMENTS

| | | | |
|---|---|---|---|
| 5,408,899 | A | 4/1995 | Stewart |
| 5,529,296 | A | 6/1996 | Kato et al. |
| 5,829,317 | A | 11/1998 | Vreeken et al. |
| 5,868,040 | A | 2/1999 | Papenhagen et al. |
| 5,934,152 | A | 8/1999 | Aschoff et al. |
| 5,937,707 | A | 8/1999 | Rixon et al. |
| 6,003,404 | A | 12/1999 | Hannewald |
| 6,070,490 | A | 6/2000 | Aschoff et al. |
| 6,098,971 | A | 8/2000 | Stege et al. |
| 6,109,241 | A | 8/2000 | Engelgau |
| 6,158,299 | A | 12/2000 | Czajkowski |
| 6,240,801 | B1 | 6/2001 | Kojima et al. |
| 6,250,176 | B1 | 6/2001 | Reimann et al. |
| 6,263,758 | B1 | 7/2001 | Kumamoto et al. |
| 6,279,883 | B1 | 8/2001 | Weis |
| 6,289,762 | B1 | 9/2001 | Silva |

(Continued)

FOREIGN PATENT DOCUMENTS

| | | | |
|---|---|---|---|
| DE | 19521821 | C1 | 12/1996 |

(Continued)

*Primary Examiner*—Vicky A Johnson
(74) *Attorney, Agent, or Firm*—Price, Heneveld, Cooper, DeWitt & Litton LLP

(57) ABSTRACT

A pedal system includes a housing, a pedal lever pivoted to the housing for rotation, and a hysteresis mechanism located above the pivot axis when mounted in a vehicle so that it is positioned in a protected position from environmental dirt and debris, and further is positioned in a more open region less subject to conflicting special requirements within the vehicle. The housing defines a closed end and an open end. The pedal lever is adapted to fit into the housing with the hysteresis mechanism already mounted on a free end of the pedal lever. A pivot pin extends through side walls of the housing and also through the pedal lever to retain the pedal lever in the housing, and is accessible for attachment of an electrical sensor for sensing angular position of the pedal. In one form, the hysteresis mechanism includes a pedal-mounted rub pad and a mating hysteresis-lever-mounted rub pad, at least one being a lubricant-impregnated material, both including angled mating surfaces for providing sliding hysteresis friction.

30 Claims, 6 Drawing Sheets

U.S. PATENT DOCUMENTS

| | | | |
|---|---|---|---|
| 6,289,763 | B1 | 9/2001 | Rixon et al. |
| 6,298,748 | B1 | 10/2001 | Rixon et al. |
| 6,336,377 | B1 | 1/2002 | Reimann et al. |
| 6,360,631 | B1 | 3/2002 | Wortmann et al. |
| 6,446,526 | B2 | 9/2002 | Reimann et al. |
| 6,450,062 | B2 | 9/2002 | Kojima et al. |
| 6,453,768 | B2 | 9/2002 | Wehner et al. |
| 6,460,429 | B1 | 10/2002 | Staker |
| 6,467,370 | B2 | 10/2002 | Kojima et al. |
| 6,474,191 | B1 | 11/2002 | Campbell |
| 6,520,046 | B2 | 2/2003 | Djordjevic |
| 6,523,433 | B1 | 2/2003 | Staker |
| 6,526,844 | B1 | 3/2003 | Weis |
| 6,553,863 | B1 | 4/2003 | Djordjevic |
| 6,575,053 | B2 | 6/2003 | Menzies |
| 6,591,712 | B2 | 7/2003 | Goto et al. |
| 6,626,061 | B2 | 9/2003 | Sakamoto et al. |
| 6,658,963 | B2 | 12/2003 | Yaddehige |
| 6,718,845 | B2 | 4/2004 | Menzies |
| 6,745,642 | B2 | 6/2004 | Kumamoto et al. |
| 6,758,114 | B2 | 7/2004 | Sundaresan et al. |
| 6,802,113 | B2 | 10/2004 | Staker |
| 6,834,564 | B2 | 12/2004 | Huesges et al. |
| 6,857,336 | B2 | 2/2005 | Staker |
| 6,860,170 | B2 | 3/2005 | DeForest |
| 2001/0011487 | A1 | 8/2001 | Kojima et al. |
| 2001/0015111 | A1 | 8/2001 | Rixon et al. |
| 2001/0022113 | A1 | 9/2001 | Kojima et al. |
| 2001/0029805 | A1 | 10/2001 | Wehner et al. |
| 2002/0005080 | A1 | 1/2002 | Reimann et al. |
| 2002/0157495 | A1 | 10/2002 | Goto et al. |
| 2003/0226419 | A1 | 12/2003 | Yokochi et al. |
| 2004/0041558 | A1 | 3/2004 | Hasegawa et al. |
| 2004/0065167 | A1 | 4/2004 | Kim |
| 2004/0149069 | A1 | 8/2004 | Caba et al. |
| 2004/0149070 | A1 | 8/2004 | Solta |
| 2004/0237700 | A1 | 12/2004 | Wurn |
| 2005/0034292 | A1 | 2/2005 | Staker |
| 2005/0034555 | A1 | 2/2005 | Staker |
| 2005/0046273 | A1 | 3/2005 | Jung et al. |
| 2005/0097983 | A1 | 5/2005 | Mannle et al. |
| 2005/0145058 | A1 | 7/2005 | Kohlen et al. |
| 2005/0155448 | A1 | 7/2005 | Lochle et al. |
| 2005/0160867 | A1 | 7/2005 | Mannle |
| 2005/0172753 | A1 | 8/2005 | Fujiwara |
| 2007/0000347 | A1* | 1/2007 | Keown et al. ..... 74/560 |

FOREIGN PATENT DOCUMENTS

| | | | |
|---|---|---|---|
| EP | 1126353 | A2 | 8/2001 |
| EP | 1357452 | A1 | 10/2003 |
| GB | 2349447 | A | 11/2000 |
| WO | 2004007929 | A2 | 1/2004 |

* cited by examiner

PEDAL WITH HYSTERESIS MECHANISM

This utility application claims benefit under 35 USC section 119(e) of provisional application Ser. No. 60/731,880, filed Oct. 31, 2005, entitled PEDAL WITH HYSTERESIS MECHANISM, the entire contents of which are incorporated herein.

BACKGROUND

The present invention relates to a pedal system for passenger vehicles having a frictional hysteresis mechanism to provide a desired amount of friction when operating a pedal and also to reduce unwanted back pressure on a driver's foot while operating the pedal. More specifically, the present invention relates to a pedal system with a hysteresis mechanism incorporated therein that facilitates assembly and that is robust, yet that maintains a minimum of components and also optimizes the location and operation of the hysteresis mechanism relative to the pedal lever.

Many of the problems and considerations for pedals with hysteresis devices are elegantly set forth in Staker U.S. Pat. No. 6,523,433, and will not be repeated here. However, further improvement is desired at least in the following areas.

Assembly of hysteresis devices can be challenging, since the spring for the hysteresis device must be compressively pre-tensioned during the assembly process. This results in a condition where the assembler needs "three hands" . . . or at least needs the assistance of a fixture or "extra components" to compressively pre-tension the spring and then hold the tension while the components are assembled. It is desirable to provide a simplified system that is more self-contained and more easily assembled, yet that has less requirement for a fixture or for a tooled "aid" to permit efficient assembly.

There are considerable safety and space-related requirements in the under-dash area of driver pedals. The environment is relatively dirty and subject to significant dust, debris, and moisture, especially at the floor level, and this can adversely affect operation of a hysteresis mechanism over time. It is desirable to protect the hysteresis mechanism and position it away from such a dirty environment, to the extent possible. Also, while the device disclosed in Staker U.S. Pat. No. 6,523,433 is relatively compact, it places the hysteresis device within his pedal beam under a pivot axis of the pedal beam. This can cause the pedal beam to become relatively large below the pedal pivot axis, potentially being "too large" for the space allowed in some pedal applications now being designed by vehicle manufacturers in the area adjacent a vehicle floor board and in front of its engine's firewall. For example, a "thick" pedal requires more room from the foot-engaging surface of the pedal to the vehicle floor. A pedal system is desired that allows the pedal beam to remain relatively smaller in cross-sectional size, especially as it extends downwardly and forwardly from the pedal pivot axis.

Additionally, a pedal system is desired that provides a pivot pin location and support that is both robust and also optimally accessible and well-suited for connection to an electrical device for sensing angular position of the pedal beam. In particular, it is desirable to provide balanced support for the pedal pivot pin where the two side walls of a housing that support the pivot pin are integrally formed and interconnected as part of a unitary molding (as opposed to a multi-piece housing). This assures that the opposing ends of the pivot pin are equally well supported, and also eliminates subassembly operations. Equal support at each end of the pedal pivot pin can be very important in the event of a high-force pedal actuation in a crisis situation, such as urgent actuation of the pedal system during a pending vehicle crash, so that one side does not overpower a second side wall in a manner leading to twisting and unbalanced support of the pedal . . . which would in turn lead to other concerns.

Thus, a system is desired having the aforementioned advantages and solving the aforementioned problems.

SUMMARY OF THE PRESENT INVENTION

In one aspect of the present invention, a pedal system includes a housing comprising a one-piece molding with opposing side walls defining a cavity. An access opening to the cavity opens generally downwardly when the housing is in a vehicle-mounted position. The housing is adapted for attachment to a vehicle. A pedal lever is pivoted to the housing for rotation about a pivot, and a hysteresis mechanism is located above the pivot axis and on an opposite side of the pivot axis from a majority of the pedal lever when the housing is in a vehicle-mounted position. The pedal lever and hysteresis mechanism are shaped to fit into the access opening into operative positions within the housing. By this arrangement, the hysteresis mechanism is positioned in a more protected position from dirt and debris commonly associated with the floor area of vehicles, and further the mechanism is positioned in a region that is more open and less subject to conflicting special requirements within the vehicle.

In another aspect of the present invention, a pedal system includes a housing adapted for attachment to a vehicle, a pedal lever, and a hysteresis mechanism. The housing includes side walls defining a cavity with a closed end and an open end and an internal corner adjacent the closed end. The pedal lever is adapted to fit operably between the side walls of the housing. The hysteresis mechanism is mounted on an end of the pedal lever and adapted to fit through the open end into operative engagement with the closed end, the hysteresis mechanism including a hysteresis lever and a hysteresis spring operably engaging the hysteresis lever, the hysteresis lever including a portion pivotally engaging the internal corner. A pivot pin extends through side walls of the housing and also through the pedal lever to retain the pedal lever in the housing.

In another aspect of the present invention, a pedal system includes a housing defining a cavity, and a pedal assembly shaped to slide into the cavity. The pedal lever has a configured end, and the hysteresis mechanism is pre-assembled onto the configured end. A pivot member pivotally secures the pedal assembly to the housing with the hysteresis mechanism in an operative position for applying a hysteresis force to the pedal when the pedal is operated.

In yet another aspect of the present invention, a method of assembling a pedal system comprises steps of providing a housing adapted for attachment to a vehicle, the housing including side walls defining a closed end and an open end, and providing a pedal lever adapted to fit between the side walls of the housing. The method further includes attaching a hysteresis mechanism to a free end of the pedal lever to form a pedal subassembly, the pedal subassembly being adapted to fit through the open end into operative engagement with the closed end, and installing a pivot pin through side walls of the housing and also through the pedal lever to retain the pedal lever in the housing.

In another aspect of the present invention, a pedal system for a vehicle includes a housing configured for mounting to a vehicle, a pedal lever pivoted to the housing for rotation about a first pivot axis, and a hysteresis mechanism operating between the housing and the pedal lever. The hysteresis mechanism includes at least one rub pad configured to create a sliding hysteresis frictional force when the pedal lever is rotated. The rub pad is movably supported so that the rub pad maintains optimal contact at all times.

In another aspect of the present invention, a pedal system for a vehicle includes a housing configured for mounting to a vehicle, a pedal lever pivoted to the housing for rotation about a first pivot axis, and a hysteresis mechanism including a hysteresis lever operating between the housing and the pedal lever. The hysteresis mechanism further includes a pedal-lever-mounted rub pad and a hysteresis-lever-mounted rub pad configured to create a sliding hysteresis frictional force when the pedal lever is rotated. At least one of the pedal-lever-mounted rub pad and the hysteresis-lever-mounted rub pad are movably supported so that optimal contact is maintained at all times.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
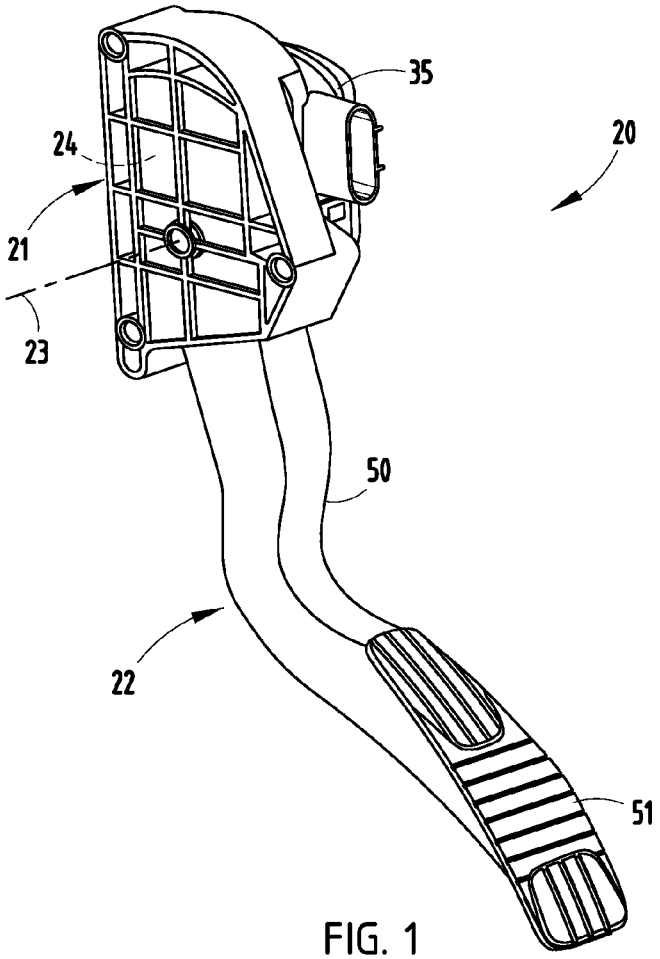
FIGS. 1 and 1A are perspective views of a pedal system embodying the present invention.
Figure 1A:
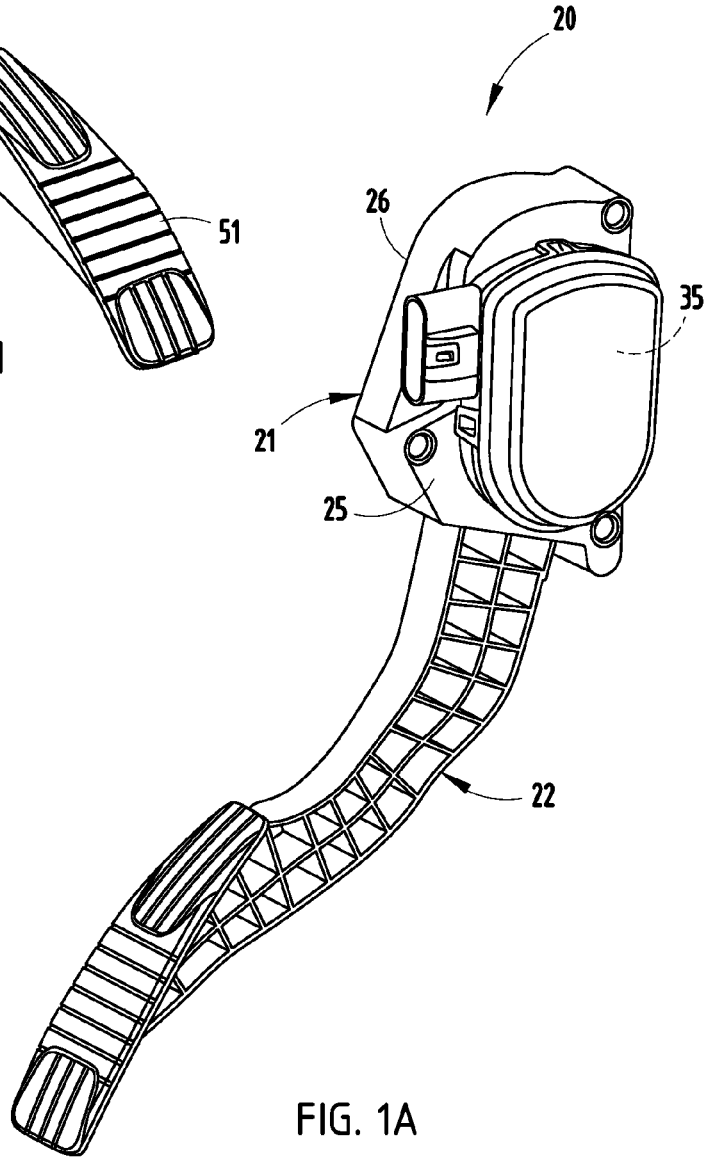
Figure 4:
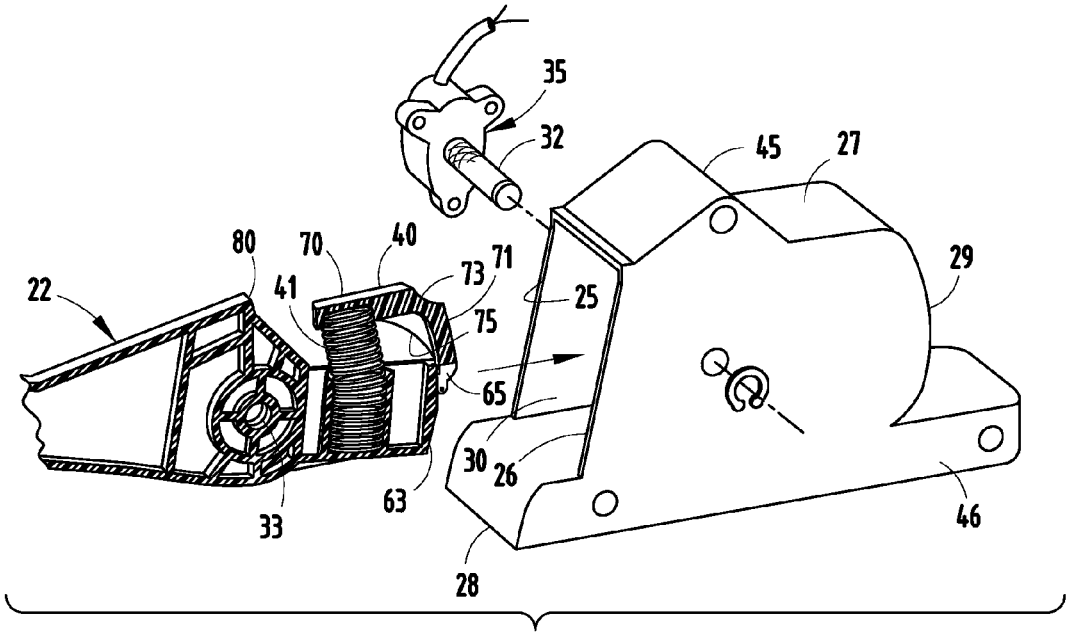
FIG. 4 is an exploded perspective view of the pedal in FIG. 1, showing a method of assembly.

A pedal system 20 (FIG. 1) includes a housing 21, a pedal lever 22 pivoted to the housing 21 for rotation about an axis 23, and a hysteresis mechanism 24 (FIGS. 2 and 4) mounted on the pedal lever 22. The hysteresis mechanism 24 is advantageously located above the pivot axis 23 of the pedal lever 22 when the housing 21 is oriented (i.e., mounted) in a vehicle-installed position. Thus, when installed, the hysteresis mechanism 24 (including its hysteresis lever 40 and hysteresis spring 41) is positioned in a raised, protected, remote position above the pivot axis 23 where it is more protected from environmental dirt and debris, and further is positioned in a more open region less subject to conflicting special requirements within the vehicle.

Figure 3:
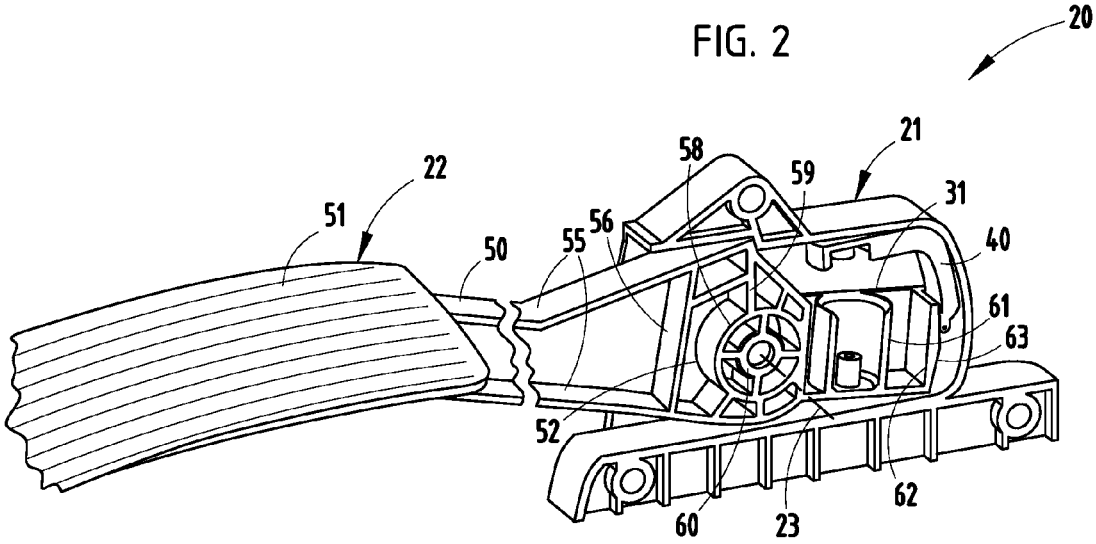

The illustrated housing 21 (FIGS. 3-4) is a one-piece molding and includes opposing side walls 25 and 26 connected at top and bottom edges by walls 27 and 28 to define an internal cavity with a closed end 29 and an open end 30. The pedal lever 22 is adapted to fit into the housing 21 with the hysteresis mechanism 24 already mounted on a configured end 31 (see FIG. 4), as described below, which greatly facilitates assembly. A pivot pin 32 extends through side walls 25 and 26 of the housing 21 and also through a mating hole 33 in the pedal lever 22 to retain the pedal lever in the housing 21. Advantageously, the one end 34 of the pivot pin 32 is accessible outside of the side wall 25 for attachment of an electrical sensor 35 (e.g., potentiometer) for sensing angular position of the pedal lever 22.

More specifically, as noted above, the housing 21 (FIGS. 3-4) includes side walls 25 and 26, and top and bottom walls 27 and 28 that define a cavity. The upper closed end 29 of the housing 21 is closed to reduce the tendency for debris to fall into the cavity. The open end 30 of the housing 21 faces generally downwardly when in a vehicle-mounted position on the firewall of a vehicle. The illustrated housing 21 includes three apertured attachment flanges 45 (more or less could be used, or other attachment could be provided) for bolt-attachment to the side of a brake-pedal-supporting bracket on the vehicle's firewall under the vehicle's instrument panel. One or more of the apertured flanges may be positioned on a protruding leg 46, which gives mechanical advantage for maintaining the housing 21 in a fixed attached position, even when torsional pressure is put onto the housing 21.

The illustrated housing 21 is a unitary one-piece molded part of structural plastic, but it is contemplated that it could also be made of metal or other material, depending on functional considerations of the vehicle manufacturer. Since the present pedal system is designed for an accelerator pedal which receives relatively less foot pressure, it is contemplated that plastic will work well. Further, plastic has the advantage that the entire component can be made in a single molding operation, thus reducing secondary operations. Nonetheless, secondary operations can be used as needed. For example, the bearings could be attached at holes 33 in the pedal lever 22 or in the housing if improved bearing properties are desired over the plastic material of the housing 21.

The pedal lever 22 (FIG. 2) includes a pedal arm 50 with an unattached free end, a foot-engaging pad 51 supported on the free end, a pivot-forming section 52 on the arm 50 opposite the free end, and a configured end 31 on an upper outer side of the pedal pivot axis 23. Ribs and walls are provided for making the arm 50 sufficiently strong and rigid for its intended purpose. The illustrated arm 50 of the pedal lever 22 includes longitudinally-extending walls 55 and a plurality of reinforcement ribs 56 that extend perpendicularly to the wall 55 and at various angles to each other for optimally distributing and handling stress on the pedal lever 22. As noted above, the illustrated pedal lever 22 is designed for use as an accelerator pedal, such that it does not have the high stress requirements of a brake pedal. Nonetheless, it is noted that the present inventive arrangement can be used on any pedal system. Further, it is contemplated that the present pedal arm 50 can be made in many different configurations.

The pivot-forming section 52 of pedal lever 22 includes a plurality of radial and circumferential walls 57 and 58 that extend in various directions and at various angles to each other around the pivot hole 60 for distributing and handling stress on the pivot-forming section 52 around pivot pin 32.

Figure 5:
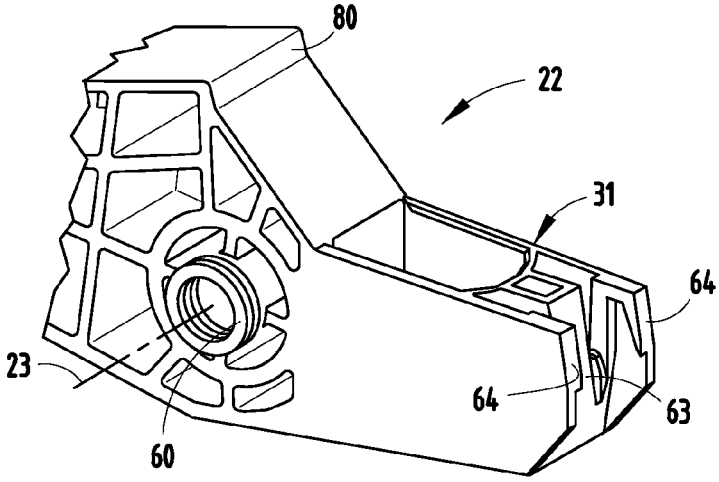
FIGS. 5-7 are fragmentary end views of the configured end of the pedal lever of FIG. 1, FIG. 5 showing the configured end alone, FIG. 6 showing the configured end with hysteresis lever and spring, and FIG. 7 showing a longitudinal cross section removing part of the side wall of the configured end to better show the internal arrangement.
Figure 6:
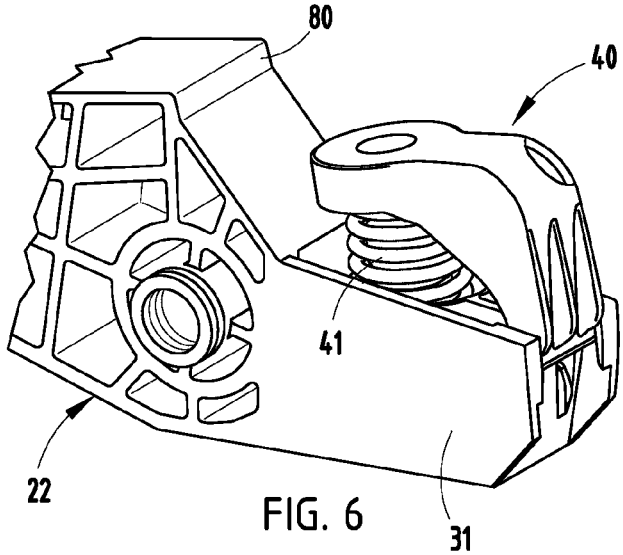
Figure 7:
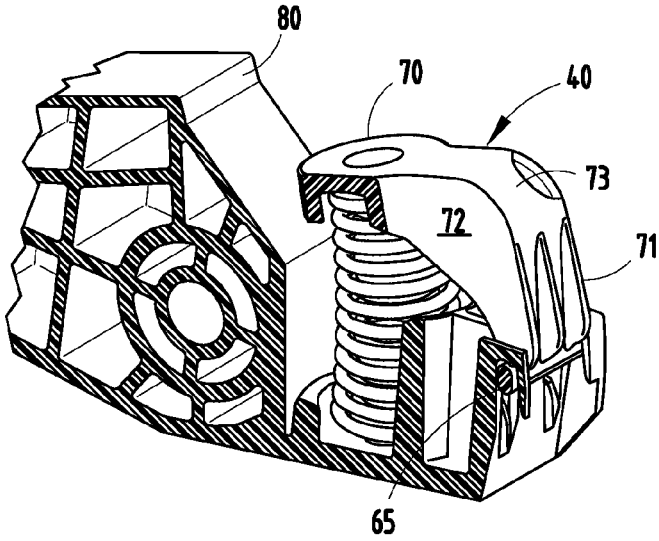
Figure 8:
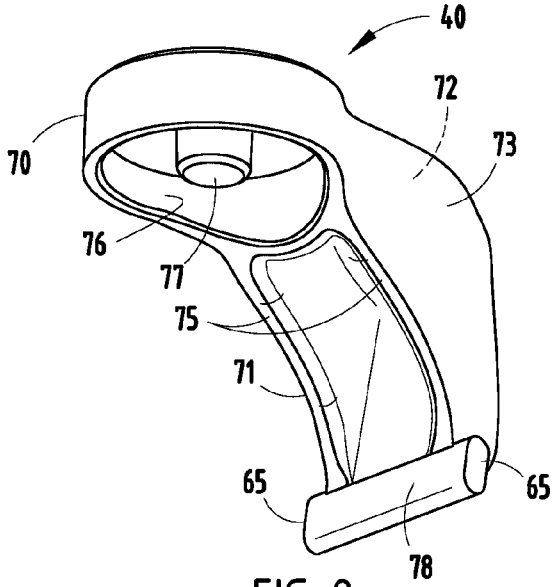
FIGS. 8-11 are underside perspective, top-side perspective, side, and bottom views of the hysteresis lever of FIG. 6.

The configured end 31 of the pedal lever 22 extends from the pivot-forming section 52 on a side opposite the pedal arm 50 from the pivot axis 23. It also includes various walls and reinforcement ribs as necessary for rigidity. In particular, the configured end 31 includes a cylindrical wall 61 forming a pocket for receiving about half of the spring 41, and also includes an end wall 62 having an arcuately or curvilinearly shaped friction surface 63 on its outboard side. The friction surface 63 can be optimally shaped to provide the frictional resistance in the hysteresis mechanism 24 as the hysteresis lever 40 slides across the friction surface 63, as discussed below. A pair of edge-located L-shaped ridges 64 (FIG. 5) are formed vertically on at least the upper half inch of the end wall 62 along the edges of the friction surface 63. The ridges 64 form a pair of inwardly facing parallel grooves shaped to positively slidably engage the laterally extending protrusions 65 (FIGS. 7-8) on the lower end of the hysteresis lever 40. This permits preassembly of the hysteresis lever 40 and spring 41 on to the configured end 31 of the arm 50. A top end of the grooves are closed, such that, when assembled, the protrusions 65 are captured and thus hold the hysteresis lever 40 onto the configured end 31, with the spring 41 compressively pre-tensioned. This arrangement allows the hysteresis mechanism 24 (i.e. hysteresis lever 40 and spring 41) to be preassembled onto the configured end 31, with the spring 41 pre-tensioned. The pedal pre-assembly (i.e., pedal lever 22 and hysteresis mechanism 24) can thus be slid directly into the open end 30 into an operative position.

Figure 9:
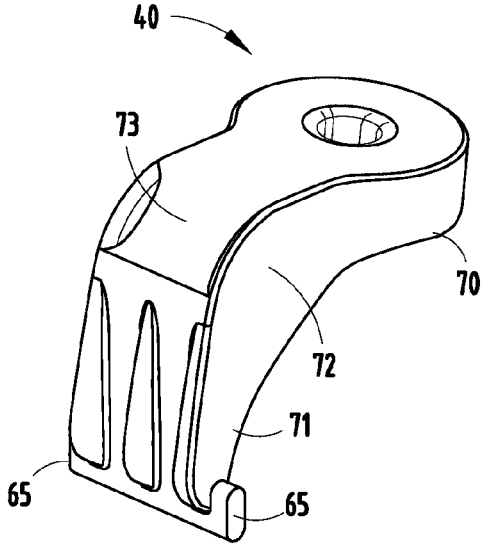
Figure 10:
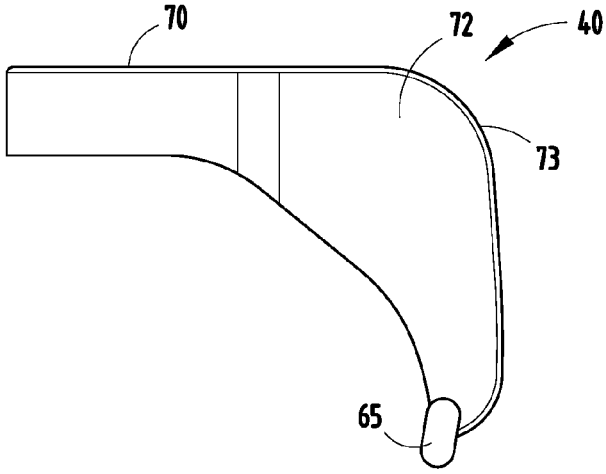
Figure 11:
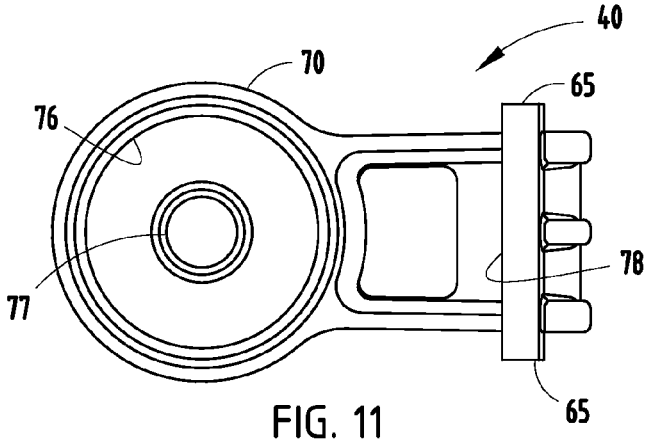

The hysteresis lever 40 (FIGS. 8-10) is L-shaped and includes a spring-engaging leg 70, a friction-pad-forming leg 71 that extends at about 90 degrees from the leg 70 (or more preferably at about 80 to 85 degrees in the illustrated design), and a corner-forming section 72. The corner-forming section 72 includes a concave cylindrical outer surface 73 (FIG. 2) shaped to rotatably engage a mating surface 74 on a concave corner of the cavity at the closed end 29 of the configured end 31. Triangularly-shaped parallel reinforcement walls 75 extend between the legs 70 and 71 on outer surfaces thereof to stiffen and rigidify the legs 70 and 71 relative to each other. Leg 70 includes a cylindrical wall 76 defining a pocket and a center stud 77 for securely receiving and engaging an end of the spring 41. The leg 71 includes a curvilinear surface 78 on an inner side for slidingly engaging the friction surface 63 on the outboard end of the pedal lever 22. A step 80 (FIG. 2) on the pedal lever 22 is shaped and located to abuttingly engage a stop 81 in the cavity of the housing 21 when the pedal lever 22 is not depressed (i.e., for an accelerator pedal, when the pedal lever 22 is in an engine idle position).

Modification

A modified pedal system 20A (FIGS. 12-13) includes a pedal lever 22A and modified hysteresis mechanism 24A. In FIGS. 12-16, similar and identical components are identified by the same numbers, but with the addition of the letter "A" or "B". This is done to reduce redundant discussion.

The pedal system 20A (FIGS. 12-15) incorporates a hysteresis spring like spring 41 (FIG. 2), and fits into a housing like housing 21. Also, the pedal lever 22A and hysteresis mechanism 24A operate generally the same as the pedal lever 22 and hysteresis mechanism 24. However, the modified hysteresis mechanism 24A (FIG. 12) incorporates a separate pedal beam rub pad 100 on its pedal lever 22A and a separate hysteresis lever rub pad 101 on its hysteresis lever 40A that allow optimization of the hysteresis mechanism, as described below.

It is important that the hysteresis mechanism provide a consistent and desired level of hysteresis friction. However, this is not easily done in an environment next to a vehicle floor, which tends to be dirty and moist. Further, materials that are optimal for creating a durable, consistent sliding friction (i.e. for the frictional rub pads) tend to be more expensive than lower-cost structural plastic materials (i.e. for the pedal lever). This is problematic because, if the entire pedal lever is made of an optimal material for creating a consistent friction, the pedal will be prohibitively expensive. Also, material providing optimal structural integrity (i.e. for the pedal lever) may be different than materials having optimal frictional properties (i.e. for the rub pad). The same conflicting requirements are true for the hysteresis lever and rub pad. Notably, it is contemplated that a modified pedal system may include only one separate rub pad (instead of both pads 100 and 101) if acceptable hysteresis friction can be achieved for a particular application.

Figure 2:
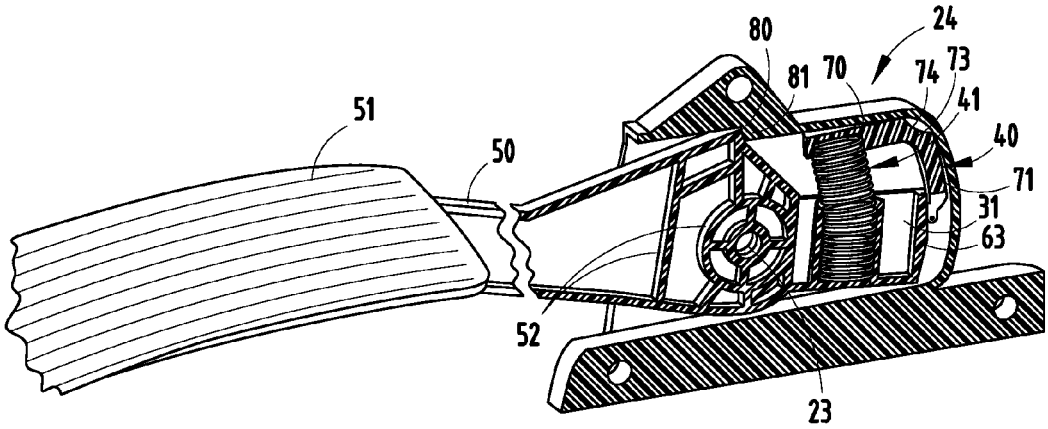
FIGS. 2-3 are perspective views similar to FIG. 1, but with parts of the side walls removed on the housing and pedal lever (and in FIG. 3 the spring removed) to better show parts underneath.
Figure 12:
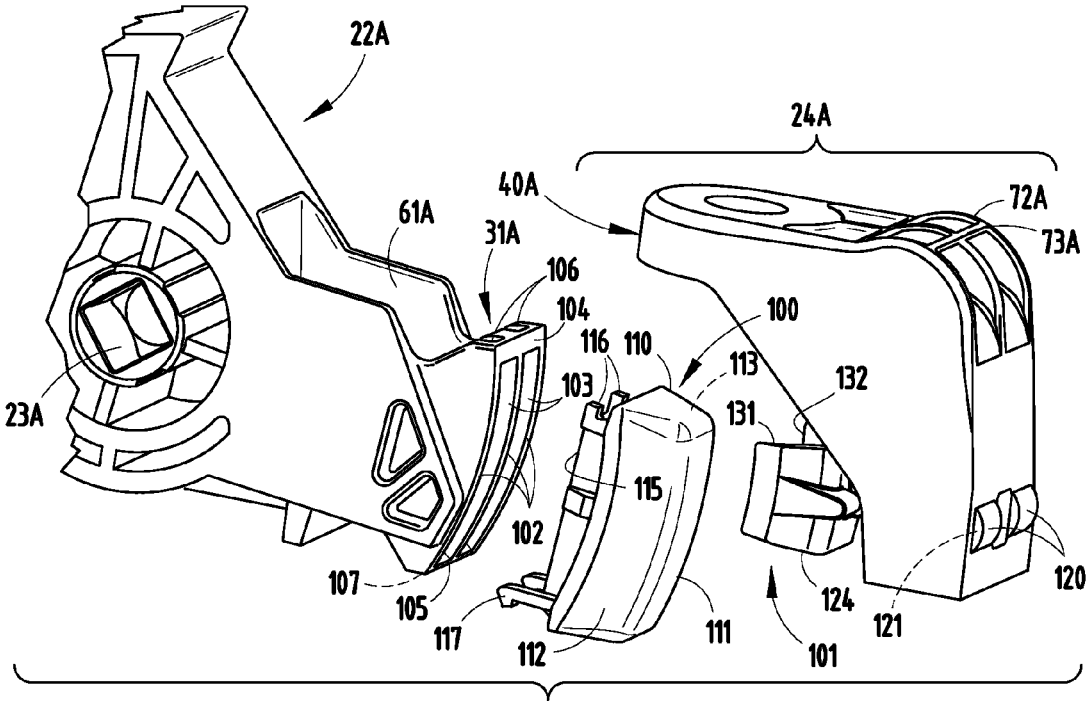
FIGS. 12-13 are exploded perspective and side views of a pedal with modified hysteresis mechanism.
Figure 13:
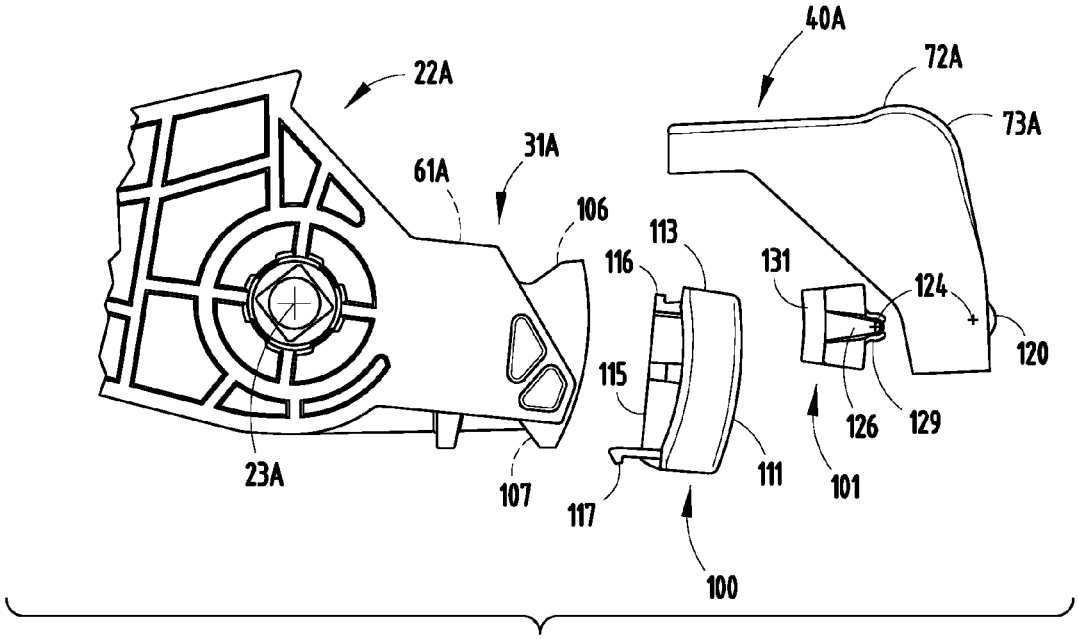
Figure 14:
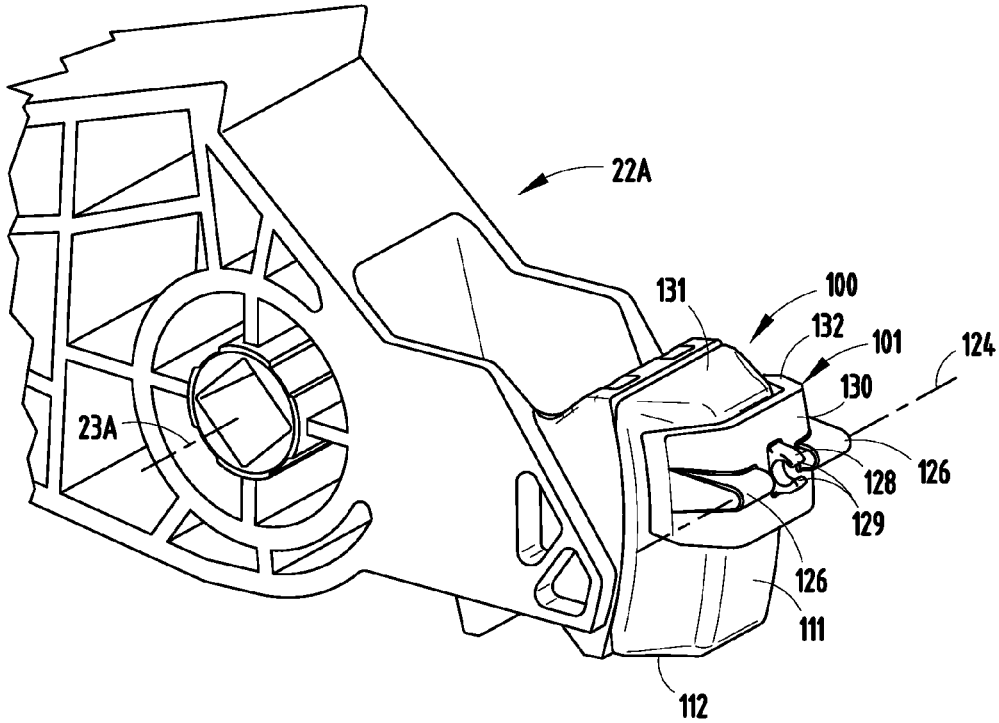
FIG. 14 is a perspective view of a pedal incorporating the hysteresis mechanism of FIG. 13, but with the hysteresis lever removed to better show hidden components.
Figure 15:
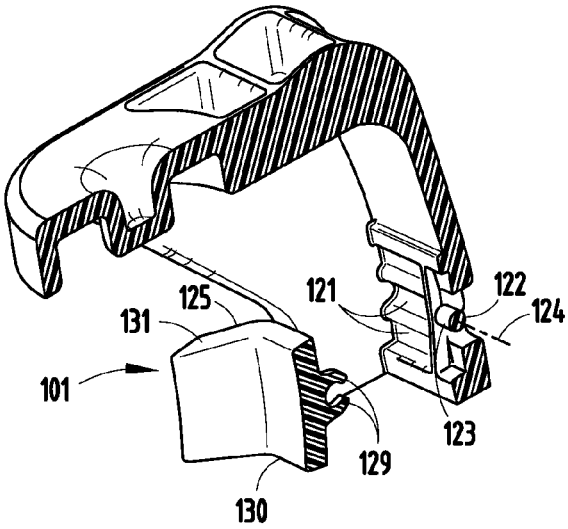
FIG. 15 is a perspective cross sectional view taken through the hysteresis lever and hysteresis rub pad.

The modified pedal lever 22A is a one-piece molded part of structural plastic, and includes a configured end 31A with pocket 61A for receiving a hysteresis spring (not illustrated in FIG. 12, but see FIG. 2). The outer end of the configured end 31A includes parallel walls 102 forming vertical channels 103 and further includes top and bottom walls 104 and 105 closing the channels 103. The top and bottom walls 104 and 105 each include a pair of apertures 106 and 107, respectively that connect to the channels 103.

The pedal beam rub pad 100 is configured to matably engage the outer end of the pedal lever 22A, and to form an outer friction surface optimally shaped to provide the frictional resistance in the hysteresis mechanism 24A as the hysteresis lever 40A slides across the friction surface. The pedal beam rub pad 100 includes a body 110 with an arcuate outer surface 111 and arcuate side surfaces 112 and 113 each extending around the pivot axis 23A of the pedal lever 22A. The side surfaces 112 and 113 are angled inwardly toward each other and form the friction surface for engaging mating surfaces on the hysteresis lever rub pad 101. (When engaged by the hysteresis lever rub pad 101, the outer arcuate surface 111 is spaced slightly from the center surface on the hysteresis lever rub pad 101, so that the angled side surfaces are the surfaces that contact each other for providing a frictional hysteresis force.) A pair of ribs 115 on the body 110 fit into the channels 103, with a pair of retainer hooks 116 engaging the top apertures 106. A pair of resilient hooks 117 extend from the body 110 and snappingly engage the bottom apertures 107 to retain the pedal beam rub pad 100 securely on the pedal lever 22A. The surfaces 111-113 extend a length at least as long as the distance of travel when the pedal lever 22A is depressed.

The hysteresis lever 40A is modified to include a pair of strips 120 forming aligned arcuate bearing surfaces 121 facing toward the configured end 31A, and further is modified to include an attachment rod 122 forming a bearing surface 123, with the bearing surfaces 121 and 123 defining a common pivot axis 124. The hysteresis lever rub pad 101 includes a body 125 with a pair of protrusions 126 forming cylindrical bearings (FIG. 14) configured to matably pivotally engage the bearing surfaces 121, and further includes a center rib 128 with opposing fingers 129 for snappingly rotatingly engaging the rod 122. The body 125 is generally U-shaped for matingly engaging the rub pad 100. Specifically, the body 125 includes a center wall 130 generally positioned over the surface 111 on the pedal lever 22A and includes opposing angled side walls 131 and 132 that matably slidingly engage the side surfaces 112 and 113 on the pedal beam rub pad 100. The angle of the side walls 131 and 132 and side surfaces 112 and 113 are oriented relative to the direction of biased engagement so as to provide mechanical advantage, such that the bias provided by the hysteresis spring (41) is effectively multiplied, such that their sliding engagement provides an increased level of frictional engagement. It will be recognized that particular angle selected during the design process can be varied widely to achieve increasing (or decreasing) hysteresis frictions. The illustrated angle between the center surface 111 and the side surfaces 112 (and 113) is between about 45 degrees to 85 degrees, and more preferably is between about 65 degrees to 80 degrees. The pivotal support of the hysteresis lever rub pad 101 on axis 124 allows the hysteresis rub pad 101 to adjust and maintain full contact with the pedal beam rub pad 100, even if there is slight variation in the assembly or variation in the components as manufactured, and even if there is slight non-uniform wear relative to the axis of rotation 23A for the pedal lever 22A.

By this arrangement, optimal materials can be selected for one or both of the pedal beam rub pad 100 and the hysteresis lever rub pad 101 . . . as well as for the pedal lever 22A and the hysteresis lever 40A. For example, it is contemplated that a lubricant impregnated or graphite-containing polymeric material can be chosen for one or both of the rub pads 100 and 101, while a lower-cost structural polymer (potentially glass filled) can be selected for the pedal lever 24A. Also, it is contemplated that the pedal lever and/or the hysteresis lever could be made of metal or other composite material.

It is noted that the hysteresis lever 40A includes a corner-forming section 72A (FIG. 12) on the hysteresis lever 40A defines a convex outer surface 73A (instead of the concave surface 73). However, it engages a corner in the housing (see housing 21) to provide a similar pivotal support as described in regard to the pedal system 20 described above.

Figure 16:
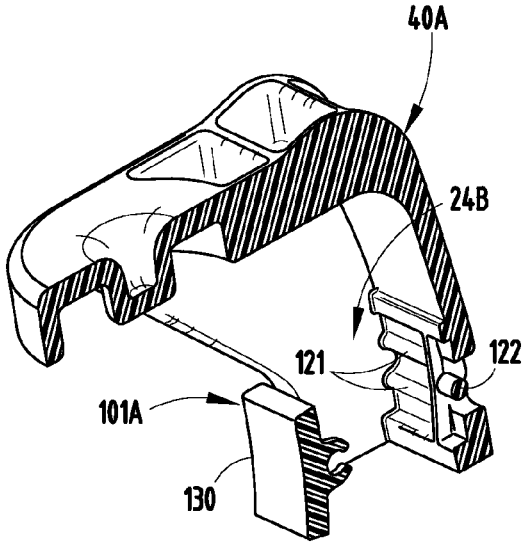
FIG. 16 is a perspective cross sectional view similar to FIG. 15, but with a modified hysteresis rub pad.

FIG. 16 illustrates a flexibility of the present concepts. In FIG. 16, a modified hysteresis mechanism 24B includes a hysteresis-lever-mounted rub pad 101A with a relatively flat friction-generating surface. The rub pad 101A is configured to pivotally mount to the hysteresis lever 40A in the same way that the rub pad 101 mounts to the lever 40A. However, the rub pad 101A has a (relatively-flat) cylindrically-shaped center wall 130A forming a bearing surface for engaging the mating outer surface (111) on a mating pedal-mounted rub pad (100). (See the arcuate mating outer surface 111 in FIG. 12 on the pedal-beam-mounted rub pad 100 on the configured end of the pedal lever 22A). The hysteresis mechanism 24B lacks the mechanical advantage provided by the angled side surfaces 112 and 113 and mating side surfaces 131 and 132. However, in the hysteresis mechanism 24B, one or both of the materials of the rub pads 100A and 101A can be selected for optimal results, including consistent predictable friction despite the moist and dirty environment, good long term wear, and excellent robustness of the design, while maintaining low cost and optimal design flexibility. Part of this consistency is due to the pivotal support where the hysteresis-lever-mounted rub pad 101A is mounted for angular adjusting movement about pivot axis 124.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A pedal system comprising:

a housing comprising a one-piece molding integrally formed of continuous contiguous material with side walls defining a cavity closed on all sides except defining a single access opening to the cavity at one end that opens generally downwardly when the housing is in a vehicle-mounted position and defining pivot-pin-receiving holes, the housing being adapted for attachment to a vehicle;

a pedal lever pivoted to the housing for rotation about a pivot pin extending through the pivot-pin-receiving holes to define a pivot axis; and a hysteresis mechanism located above the pivot axis and on an opposite side of the pivot axis from a majority of the pedal lever when the housing is in a vehicle-mounted position, the pedal lever and hysteresis mechanism being shaped to fit into the access opening into operative positions within the housing, the hysteresis mechanism including protrusions pivotally engaging the pedal lever.

2. The pedal system defined in claim 1, wherein the housing comprises a plastic material.

3. The pedal system defined in claim 2, wherein the housing includes a closed end that houses the hysteresis mechanism.

4. The pedal system defined in claim 3, wherein the hysteresis mechanism includes a hysteresis lever and a spring that biases the hysteresis lever against a mating surface on an end of the pedal for providing a frictional hysteresis effect.

5. The pedal system defined in claim 4, wherein the closed end of the housing includes a corner surface operably pivotally supporting the hysteresis lever.

6. The pedal system defined in claim 5, including a pivot pin that engages both side walls of the housing for pivotally supporting the pedal lever on the housing, and further including an angular measuring device for measuring angular rotation of the pedal lever that is mounted to one of the side walls at the pivot pin.

7. The pedal system defined in claim 1, wherein one side of the housing is adapted to bolt laterally to a mounting bracket extending from an under-dash vehicle firewall.

8. The pedal system defined in claim 7, including an electrical sensor device for sensing an angular position of the pedal lever, and wherein another side of the housing supports the electrical sensor device.

9. The pedal system defined in claim 1, including a stop on the pedal that engages a mating surface on the housing adjacent an attachment flange of the housing, the stop abuttingly engaging the mating surface to set a predetermined angular position of the pedal lever at idle when the pedal lever is not depressed.

10. The pedal system defined in claim 1, wherein the hysteresis mechanism is an assembly comprising a hysteresis lever retained on end of pedal, and a hysteresis spring held in position therebetween in a compressed position so as to bias a portion of the hysteresis lever away from the pedal level.

11. The pedal system defined in claim 10, wherein the hysteresis mechanism consists of the hysteresis lever, the hysteresis spring, and a hysteresis-lever-engaging surface on the pedal lever.

12. The pedal system defined in claim 1, wherein the hysteresis mechanism includes a hysteresis lever, and wherein the housing defines a corner that pivotally supports the hysteresis lever.

13. The pedal system defined in claim 1, wherein the pedal lever includes a slide surface on an end of the pedal lever, and wherein the hysteresis mechanism includes a hysteresis lever that slidably engages the slide surface when the pedal lever is depressed to thus provide a hysteresis effect when the pedal lever is operated.

14. The pedal system defined in claim 1, wherein the housing includes a closed end and an open end, and wherein the hysteresis mechanism is mounted on a free end of the pedal lever for fitting through the open end into operative engagement with the closed end, and including the pivot pin extending through side walls of the housing and also through the pedal lever to retain the pedal lever in the housing.

15. A pedal system comprising:

a housing adapted for attachment to a vehicle and including side walls defining a cavity with a closed end and an open end and an internal corner adjacent the closed end;

a pedal lever adapted to fit between the side walls of the housing;

a hysteresis mechanism mounted on an end of the pedal lever and adapted to fit through the open end into operative engagement with the closed end, the hysteresis mechanism including a hysteresis lever with protrusions pivotally engaging mating grooves on the pedal lever to pivotally support the hysteresis lever and a hysteresis spring operably engaging the hysteresis lever, the hysteresis lever including a portion pivotally engaging the internal corner; and a pivot pin extending through side walls of the housing and also through the pedal lever to retain the pedal lever in the housing.

16. The pedal system defined in claim 15, wherein an end of the pedal lever includes a slide surface for operably slidably engaging the hysteresis lever.

17. The pedal system defined in claim 15, including an angular measuring device for measuring rotation of pedal lever, the measuring device being mounted to one of the side walls.

18. The pedal system defined in claim 17, wherein the angular measuring device communicates an electrical signal representing an angular position of the pedal lever.

19. A pedal system comprising:

a housing defining a cavity;

a pedal assembly including a pedal lever with a configured end and a hysteresis mechanism pre-assembled onto the configured end, the configured end and the hysteresis mechanism being shaped to slide into the cavity as a unit, the hysteresis mechanism including one of a pair of aligned protrusions and aligned grooves configured to matingly receive the aligned protrusions to pivotally mount the hysteresis mechanism to the pedal lever, and the pedal lever including the other of the aligned protrusions and aligned grooves; the aligned protrusions and grooves being engaged to define a pivot axis; and a pivot member pivotally securing the pedal assembly to the housing with the hysteresis mechanism in an operative position for applying a hysteresis force to the pedal when the pedal is operated.

20. A pedal system for a vehicle, comprising:

a housing configured for mounting to a vehicle;

a pedal lever pivoted to the housing for rotation about a first pivot axis; and a hysteresis mechanism operating between the housing and the pedal lever, the hysteresis mechanism including a hysteresis lever with at least one rub pad configured to create a sliding hysteresis frictional force when the pedal lever is rotated and further including protrusions pivotally engaging mating structure on the pedal lever to define a pivot axis so that the rub pad is movably supported so that the rub pad maintains optimal contact at all times.

21. The pedal system defined in claim 20, wherein the at least one rub pad is pivotally supported.

22. The pedal system defined in claim 21, wherein the hysteresis mechanism includes a hysteresis lever, and the at least one rub pad is pivotally supported on the hysteresis lever.

23. The pedal system defined in claim 22, wherein the at least one rub pad includes a first rub pad supported by the hysteresis lever, and a second rub pad supported on the pedal lever, the second rub pad engaging the first rub pad.

24. The pedal system defined in claim 23, wherein the first and second rub pads are biased toward each other along a first direction and include surfaces defining an acute angle to the first direction.

25. The pedal system defined in claim 20, wherein the at least one rub pad is made from a lubricant-impregnated material.

26. A pedal system for a vehicle, comprising:

a housing configured for mounting to a vehicle;

a pedal lever pivoted to the housing for rotation about a first pivot axis; and a hysteresis mechanism including a hysteresis lever operating between the housing and the pedal lever, the hysteresis mechanism further including a hysteresis lever with first pivot-forming structure forming a pivot axis when engaged with mating second pivot-forming structure on the pedal lever and having a pedal-lever-mounted rub pad and a hysteresis-lever-mounted rub pad configured to create a sliding hysteresis frictional force when the pedal lever is rotated, at least one of the pedal-lever-mounted rub pad and the hysteresis-lever-mounted rub pad being movably supported for angular adjustment so that optimal contact is maintained at all times.

27. The pedal system defined in claim 26, wherein the at least one rub pad is pivotally supported.

28. The pedal system defined in claim 27, wherein the hysteresis-lever-mounted rub pad is pivotally supported on the hysteresis lever.

29. The pedal system defined in claim 26, wherein the pedal-lever-mounted rub pad is made from a lubricant-impregnated material.

30. The pedal system defined in claim 26, wherein one of the rub pads is U-shaped and includes first angled side surfaces, and the other of the rub pads defines a mating shape with second angled side surfaces that frictionally engage the first angled side surfaces.

* * * * *